US005241709A

United States Patent [19]

Kufner et al.

[11] Patent Number: 5,241,709

[45] Date of Patent: Sep. 7, 1993

[54] INTERFACING FOR STIFFENING OUTER GARMENTS AND ITS PARTICULAR APPLICATION

[75] Inventors: Josef Kufner, Pullach; Andreas Voight, München, both of Fed. Rep. of Germany

[73] Assignee: Kufner Textilwerke GmbH, Munich, Fed. Rep. of Germany

[21] Appl. No.: 880,059

[22] Filed: May 7, 1992

[30] Foreign Application Priority Data

May 21, 1991 [EP] European Pat. Off. ..... 91108151.1

[51] Int. Cl.[5] ..... A41D 27/02; A41D 27/26; B32B 5/06; B32B 5/26

[52] U.S. Cl. ..... 2/97; 2/268; 2/272; 428/197; 428/234; 428/235; 428/238; 428/239; 428/253; 428/299; 428/300; 428/302; 428/317.1; 428/318.4

[58] Field of Search ..... 2/97, 268, 272; 428/197, 234, 235, 238, 239, 253, 299, 300, 302, 317.1, 318.4

[56] References Cited

U.S. PATENT DOCUMENTS

| | | | |
|---|---|---|---|
| 3,585,645 | 6/1971 | Moriwaki et al. | 2/272 |
| 3,598,689 | 8/1971 | Feffer et al. . | |
| 3,643,301 | 2/1972 | Weigl et al. | 2/272 |
| 4,135,025 | 1/1979 | Backes et al. | 2/272 |
| 4,357,714 | 11/1982 | Ito | 2/272 |
| 4,411,025 | 10/1983 | Magidson | 2/97 |
| 4,450,196 | 5/1984 | Kamat | 2/272 |
| 4,495,661 | 1/1985 | Kamat | 2/97 |
| 4,685,155 | 8/1987 | Fingerhut | 2/272 |
| 4,737,396 | 4/1988 | Kamat | 2/97 |
| 5,034,261 | 7/1991 | Loubinoux | 428/198 |
| 5,153,049 | 10/1992 | Grosheus | 2/272 |

FOREIGN PATENT DOCUMENTS

| | | |
|---|---|---|
| 0369046 | 5/1990 | European Pat. Off. . |
| 0387117 | 9/1990 | European Pat. Off. . |
| 2332492 | 1/1975 | Fed. Rep. of Germany . |
| 112076 | 6/1984 | Japan . |
| 48712 | 12/1987 | Japan . |

*Primary Examiner*—James C. Cannon
*Attorney, Agent, or Firm*—Scully, Scott, Murphy & Presser

[57] ABSTRACT

The invention concerns an interfacing for stiffening outer garments which is formed from a composite of a nonwoven textile (19), a warp knit fabric with synthetic multifilament threads and weft threads (20). The composite according to the invention contains a loosely bonded nonwoven fabric (19) of fibre count 1 to 5 dtex and weight class 30 to 150 g/m$^2$, a warp knit fabric of warp thread count 20 to 80 dtex, set of the warp 40 to 70 threads per 10 cm and fibre count 1 to 3.5 dtex and resilient weft threads (20) incorporated into each stitch course of the warp knit fabric of thread count 300 to 2000 dtex, set of the weft 70 to 130 threads/10 cm and, for a fibre proportion in excess of 50% by weight, a fibre count of 7 to 60 dtex. Said interfacing may be used as a backing panel interfacing or as an additional stiffening panel interfacing of garments in the region of the shoulder, armhole and shoulder area or even as a component of shoulder pads or for stiffening sleeves of outer garments in the rounded area at the top of the arm. (FIG. 2).

21 Claims, 3 Drawing Sheets

INTERFACING FOR STIFFENING OUTER GARMENTS AND ITS PARTICULAR APPLICATION

The present invention concerns an interfacing for stiffening outer garments made of a composite of a nonwoven textile with a warp knit fabric made of synthetic multifilament threads and with weft threads, as well as the particular application of the composite in outer garments.

Interfacings in the front region of the garment are used for stiffening outer garments, such as jackets and coats. The interfacings are heat-set in the front region of the garment onto the left side of the face fabric in the form of so-called whole-piece interfacings by means of dots of hot-melt adhesive on the interfacing with the application of pressure and heat. Further smaller cut sections of interfacing are also applied to said whole-piece interfacings in the region of the breast, shoulder, shoulder area and armhole, which produce a graduated increase in the stiffening effect in said regions and which are intended to produce a fluid, dimensionally stable balance between the outer form of the garment and the individual body shape of the wearer. Said additional interfacings are frequently so-called backing panel interfacings, which consist of a fabric with resilient weft yarns and increased flexural strength in the weft direction. They are usually heat-set, with adhesive nets or adhesive tapes, at their lateral cut edges to the cut section of fabric of the garment furnished with the whole-piece interfacing.

The other region of the backing panel lies loosely in the garment on the whole-piece interfacing. On said backing panel interfacing, further additional, even smaller panel interfacings in graduated sizes in the form of backings for the shoulder, armhole and shoulder area and in the form of a backing for the shoulder area alone are frequently pick stitched on using broad stitches. Said additional backings for the shoulder, armhole and shoulder area are incorporated between the backing panel interfacing and the shoulder area backing. Since the panel interfacings feel relatively firm, they are frequently covered again with a soft, fluffy and voluminous felt, nonwoven fabric or knitted fabric padding and joined therewith by heat-setting dots of hot-melt adhesive.

In general, garments provided with such interfacings are optimally stiffened, but require high production and material costs and a great deal of care in preparing the panel interfacings, their positioning and neat pick stitching. The aforementioned panel interfacings lying on top of one another and the soft panel covering must be positioned with millimetric precision and joined by expensive sewing processes to form a complete panel which must correspond to the shoulder area at the neck, give sufficient freedom around the shoulder blades, follow the curve of the armhole and guarantee a pleasant curve at the breast. The international fashion trend is for the narrower, figure-hugging outline and consequently requires a particularly clean line in the tailoring of the garment. This leads to particular problems where garments are series produced, since, in the retail trade, an increase in the number of size modifications is to be expected when the purchaser tries on the garment, which, with the complicated structure of an optimally worked current type of interlining stiffener, is particularly difficult and expensive and often causes the potential purchaser to withdraw from the purchase.

In order to simplify the structure of the complete panel interfacing, to reduce the cost of production and materials and to limit the need for extreme care whilst processing, the panel interfacings in the case of lower-quality garments are gradually being replaced partly or entirely by heat-setting interfacings which may be glued to the face fabric. Said heat-setting interfacings, the same size as the otherwise normal panel interfacings, are also heat-set onto the whole-piece interfacing in the region of the breast, shoulder, shoulder area and armhole. This has the disadvantage that in said regions the garment develops a compact, boardy and less voluminous feel. Frequently, upon wear and subsequent cleaning processes, unattractive shrinkages develop, with distinct undulations forming on the outside of the face fabric and visible wrinkles, which are not or are not easily removed by ironing.

The aim of the invention is to make available the manufacture of an inexpensive, easily incorporated interfacing requiring less work, which may serve, in particular, as an additional stiffener for the region of the shoulder, shoulder area and armhole, provides a result which, from the qualitative viewpoint, is at least equally optimal as the additional stiffeners made of several sewn-in panel interfacings and a panel covering made of a soft voluminous felt, nonwoven fabric or knitted fabric, but does not require the same amount of care during processing and, if modifications to the garment are unavoidable, makes said modifications simpler and less expensive.

According to the invention, said aim is solved by an interfacing made of a composite of a nonwoven textile, a warp knit fabric with synthetic multifilament threads and weft threads, the composite being characterised in that it has a) a loosely bonded nonwoven textile of fibre count 1–5 dtex and weight class 30–150 g/m$^2$, b) a warp knit fabric of warp thread count 20–80 dtex, set of the warp 40–70 threads/10 cm and fibre count 1–3.5 dtex, and c) resilient weft threads, incorporated into each stich course of the warp knit fabric, of yarn count 300–2000 dtex, set of the weft 70–135 threads/10 cm and, for a fibre proportion of the weft threads in excess of 50% by weight, a fibre count of 7–1000 dtex.

Said interfacing may have a flexural strength, measured in accordance with DIN 53362, of 5 to 120 p/cm$^2$, in the weft direction, may serve as a backing panel interfacing or additional stiffener for outer garments in the region of the shoulder, armhole and/or shoulder area and are also useable as a component of shoulder pads and for stiffening sleeves in the rounded part at the top of the arm.

Composite materials made of a nonwoven textile, a warp knit fabric with synthetic multifilament threads and weft threads are already known for other applications from GB-A 1 378 261. The use of such composite materials in the form of heat-settable whole-piece interfacings is described in EP 0 119 754. Here, compactly compressed nonwoven fabrics are joined with a warp knit fabric and weft threads, and a grid-type coating of adhesive is applied to the side opposite the incorporated weft threads. Such an interfacing is not suitable for use as an additional stiffener with adequate quality characteristics in the breast and shoulder region. It has the same disadvantages as those heat-setting interfacings which are additionally heat-set onto a whole-piece interfacing. Moreover, there is not the softness provided by padding with a nonwoven fabric or knitted fabric placed thereupon, and the loosely incorporated warp threads intended to lie on the lining side in garments also tend to migrate, which may cause an undulating surface appearance of the garment upon wear and cleaning.

By way of comparison, only the interfacing according to the invention when used as a backing panel interfacing or in conjunction with a conventional backing panel interfacing is able to fully replace the optimum quality mentioned at the start of an additional stiffener made of several panel interfacings with a soft and voluminous padding made of a felt or a nonwoven or knitted fabric, the making up of the complete panel according to the invention being carried out in a considerably more rational manner than the complete panel made of several conventional panel interfacings and the panel covering.

The interfacing according to the invention as a sole additional backing for the shoulder, armhole, and/or shoulder area with a conventional backing panel interfacing, which serves to stiffen the breast, shoulder, armhole and shoulder area of the front part of garments, may be joined with parallel rows of stitches 3–7 cm apart and with a distance between the stitches of approximately 1.0–2.5 cm, with an angle of approximately 45° between the rows of stitches and the direction of the warp threads in the interfacing. In so doing, the rows of stitches should lie roughly parallel to each other and the weft side of the interfacing according to the invention should come into contact with the backing panel interfacing, such that the fabric side lies on the outside and against the lining side in the finished garment. Zigzag stich may, as usual, be used for the rows of stitches.

The interfacing according to the invention should be cut and joined with the conventional backing panel interfacing in such a manner that the warp threads of the interfacing in the finished garment come to lie parallel with a diagonal line from the starting point of the shoulder area at the neck to the lowest point of the armhole of the garment.

In order to simplify the work further, it is, however, also possible to provide the interfacing according to the invention with a grid-shaped coating of hot-melt adhesive on the weft thread side, in order to be able to heat-set it onto the face fabric. In order to prevent the development of a hard, unwieldy feel, it is recommended that the grid arrangement be shaped much more, as with a normal heat-setting interfacing.

The interfacing according to the invention has proved particularly suitable as a heat-setting interfacing which is coated with roughly parallel rows of dots of hot-melt adhesive, with a distance of approximately 0.5–1.5 cm between the dots of hot-melt adhesive and with a distance of approximately 2.5–4 cm between the rows of dots and an angle of approximately 45° between the rows of dots and the direction of the warp threads of the interfacing. Said interfacing may be heat-set in the form of a panel interfacing onto the backing panel interfacing in such a manner that the warp direction of the backing panel interfacing and the direction of the rows of dots are parallel. Since the coating of hot-melt adhesive is located on the weft thread side, the nonwoven fabric side in the finished garment comes to lie turned towards the lining side. In said arrangement, a round, voluminous, non-unwieldy feel is achieved in the additional stiffener and, at the same time, sufficient adhesion is achieved between them, without the dots of adhesive being perceptible.

Here as well, the interfacing according to the invention should be cut and heat-set onto the conventional backing panel interfacing in such a manner that the warp threads of the interfacing in the finished garment come to lie parallel to the diagonal line from the starting point of the shoulder area at the neck to the lowest point of the armhole. When joining the backing panel interfacing, both by pick stitching and by heat-setting, the interfacing according to the invention replaces two panel interfacings and the felt or nonwoven or knitted fabric covering. The complete panel interfacing consisting of a conventional backing panel interfacing and the panel interfacing according to the invention may be joined by normal means, by heat-setting with adhesive tapes or nets, at the lateral cut edges of the backing panel interfacing with the whole-piece interfacings heat-set onto the cut piece of fabric of the garment. A narrow strip of adhesive may be applied close to the lapel fold line and a further narrow strip of adhesive may be applied to the cut curve of the armhole.

The interfacing according to the invention is used, advantageously together with a whole-piece interfacing made of a heat-settable soft nonwoven fabric interfacing, which may consist of a warp knit fabric, an incorporated, loosely bonded nonwoven fabric, a coating of hot-melt adhesive and additionally incorporated weft threads, the coating of dots being located on the weft thread side. This results in an elegant graduation of feel and secure adhesion of the complete panel interfacing to the lateral edges of the backing panel interfacing.

The nonwoven fabrics incorporated into the interfacing according to the invention may be needle-punched nonwovens, waterjet-bonded nonwovens or spot-bonded nonwovens. They may also be formed by needle-punching two or more waterjet-bonded and/or spot-bonded nonwovens of the same or different weight classes. It is also possible to use a composite of needle-punched, spot-bonded or waterjet-bonded nonwoven fabric and a thin layer of foam. If spot-bonded nonwovens are used, the synthetic proportion of the fibres should be not less than 75%. In the case of purely needle-punched or waterjet-bonded nonwovens, the fibres may also consist of viscose staple fibres or cotton. The fibres of the nonwovens should have a count of 1–5 dtex and the incorporated nonwoven should have a weight of 30–150 g/m$^2$. The warp knit fabric producing the composite of nonwoven fabric and weft threads, with a warp thread count of approximately 20–80 dtex, set of the warp approximately 40–70 threads/10 cm and the standard fibre count of 1–3.5 dtex, may preferentially have a non-offset open or preferentially closed pillar stitch weave, in which each pillar is joined with the next pillar and not with threads of the fabric. However, an offset pillar stitch weave or a tricot or linen weave or a combination of tricot and non-offset pillar stitch weave may also be selected If this is the case, the pillar stitches are joined together with the threads of the knitted fabric.

The weft threads joined to the nonwoven fabric by the stitch courses of the warp knit fabric, with a thread count of approximately 300–2000 dtex, with a consistent or differing fibre count of 7–60 dtex and a comparatively high set of the weft of 70–130 threads/10 cm, may contain monofilament, multifilament or staple fibres.

They may represent single twist yarns, double twist yarns or covered yarns. However, they may also consist of yarns with a core thread to which staple fibres, e.g. horsehair, are applied, which are incorporated with covered yarns, or the core thread of which is covered with staple fibres. The fibre material may consist of synthetic, natural or artificial fibres such as rayon, glazed yarn, goat hair, horsehair, polyester or polyamide fibre. The proportion of resilient fibres should exceed 50% by weight.

Until now, there have been technical reasons to prevent the insertion of the weft threads in each stitch course and the production of the object of the invention with a relatively high set of the weft of 70–135 threads/10 cm. The higher the selected set of the weft, the more the nonwoven fabric in the composite of nonwoven fabric, stitches and weft threads tends to interlock in the transverse direction with a severe loss of width when the composite is made up on a nonwoven Raschel machine. Surprisingly, said loss may be largely eliminated by holding the nonwoven fabric uniformly taut in the transverse direction in close proximity to the knitting machines, which may be achieved, for example, by clamping over the largest possible width in roller fabric spreaders installed in close proximity to the knitting machines. It is only through the creation of such or similar technical equipment for producing the knitted fabric with relatively high sets of the weft that it has become possible to provide them with a flexural strength in the weft direction which ensures that the shape of the garment is maintained satisfactorily in the region of the breast, shoulder, armhole and/or shoulder area. Migration of the weft threads is also eliminated by incorporating the resilient weft threads into the nonwoven fabric with the stitch courses.

The flexural strength of the interfacing according to the invention should, measured in accordance with DIN 53362, lie between 5.0 and 120 p/cm$^2$ in the weft direction and between 0.6 and 4 p/cm in the warp direction, in order to ensure that the shape of the garment is maintained satisfactorily in the region of the breast, shoulder, armhole and shoulder area.

The same interfacing may also be used, for example, as a sickle shape for stiffening and padding sleeves in the rounded area at the top of the arm. When used thus, the interfacing is, for example, placed on an interfacing cut into a sickle shape, heat-set in the rounded area at the top of the arm, which preferentially consists of a soft composite of a nonwoven textile (which is preferentially needle-punched to a foam sheet), a warp knit fabric with synthetic threads and soft weft threads incorporated into the stitches of the warp knit fabric with a coating of dots of hot-melt adhesive applied on the weft side, in the form of a cut piece which is also sickle-shaped and sewed at the cut edges of the rounded area at the top of the arm with the rounded area at the top of the arm, in such a manner that the weft threads of the cut piece at the lateral regions of the rounded area at the top of the arm are at an angle of approximately 65°–90° to the seam of the rounded area at the top of the arm of the finished garment and are at an angle of approximately 0°–35° in the upper region at the seam at the starting point of the shoulder.

With such sewing in of the interfacing, the interfacing in the upper region of the rounded area at the top of the arm near the starting point of the shoulder drops away sharply, which ensures that the interfacing may be sewn cleanly and without folding with the rounded area at the top of the arm.

Until now, some quite elaborate work has been required in comparison to said simple lining of the rounded area at the top of the arm. In general, different materials in several layers are used. Thus, for example, the rounded area at the top of the arm is heat-set onto a correspondingly cut heat-setting interfacing, a foam needle-punched to nonwoven fabric is then applied thereupon, over which wadding is placed, in order to fill out the width of the rounded area at the top of the arm and, finally, smaller panel interfacings are placed sideways in front of and behind the rounded area at the top of the arm, so that the sleeve roll produces a pleasing curve. Working in the interfacing according to the invention fulfils the same function in a much simpler manner.

Finally, it is also possible to use the interfacing according to the invention as a component of a shoulder pad for outer garments. Today's shoulder pads generally consist of a foam core with a layer of wadding and a needle-punched cover sheet. Such pads are soft and tire gradually. The interfacing according to the invention is particularly suitable as a replacement for the cover sheet and layer of wadding, in order to guarantee a correct shoulder line permanently.

The drawing shows two embodiments of the interfacing according to the invention and their working into a front part of a double-breasted jacket and an armhole trim, which are described in detail hereinafter:

Figure 1:
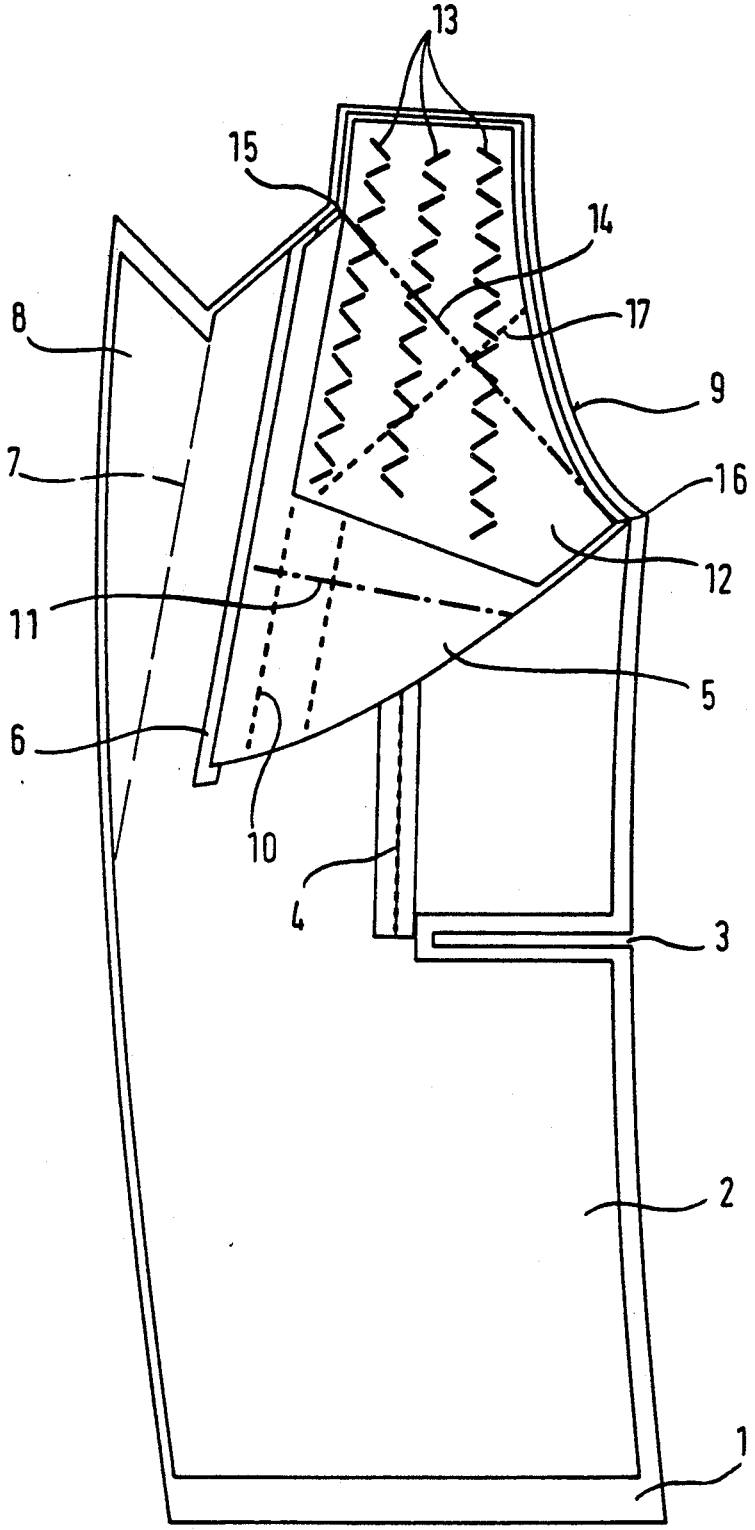
FIG. 1 shows the interfacing according to the invention on a whole-piece interfacing for a front part of a double-breasted gentleman's jacket in top view.

In the embodiment represented in FIG. 1, the cut piece of the face fabric 1 of the front part of a gentleman's double-breasted jacket is furnished with a whole-piece interfacing 2, which is heat-set onto the cut piece of face fabric 1 by means of a coating of hot-melt adhesive applied to said interfacing in a most suitable grid, e.g. in the form of dots. The face fabric 1 and the whole-piece interfacing 2 have an opening 3 for the jacket pocket and a dart 4 to create the shape of the front part of the jacket. In the upper breast and shoulder region of the front part of the jacket, a backing panel interfacing 5 is placed on the whole-piece interfacing 2, which is joined at both its lateral cut edges with the whole-piece interfacing 2 by heat-setting with adhesive tapes 6, which are applied on one side close to the fold line 7 of the jacket lapel 8 and on the other side to the cut curve of the armhole 9. There, the warp thread direction 10 of said backing panel interfacing extends roughly parallel to the fold line 7 of the jacket lapel 8, whilst the weft thread direction 11 runs roughly perpendicular thereto.

Again on said backing panel interfacing 5, a further panel interfacing 12 is applied as an additional stiffener, which is joined with the backing panel interfacing 5 by pick stitches (sewing stitches) 13. However, another connection via rows of dots of hot-melt adhesive applied and extending into the line of pick stitches is also possible. In so doing, said panel interfacing 12 is arranged on the backing panel interfacing 5 in such a manner that the warp threads of the panel interfacing come to lie parallel to a diagonal line 14 from the starting point of the shoulder area 15 at the neck of the jacket to the lowest part of the armhole 16 of the jacket and the weft threads come to lie parallel to a line 17 perpendicular thereto.

Figure 2:
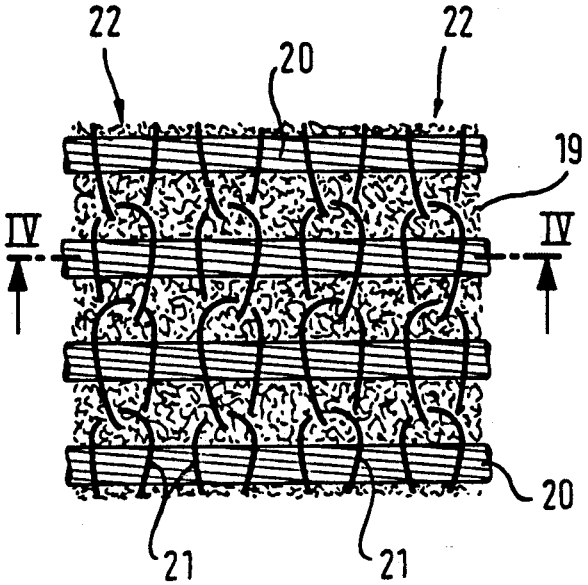
FIG. 2 shows a section of the front side of a first embodiment of the interfacing on a larger scale.
Figure 7:
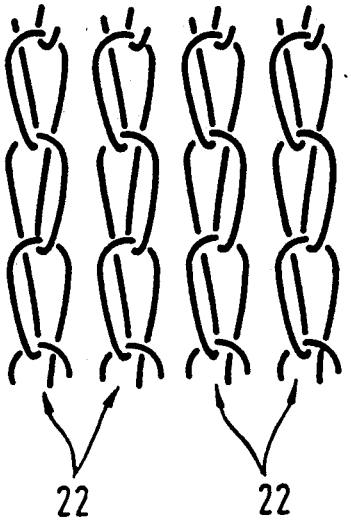
FIG. 7 shows a possible weave of the stich wale of the warp knit fabric.
Figure 3:
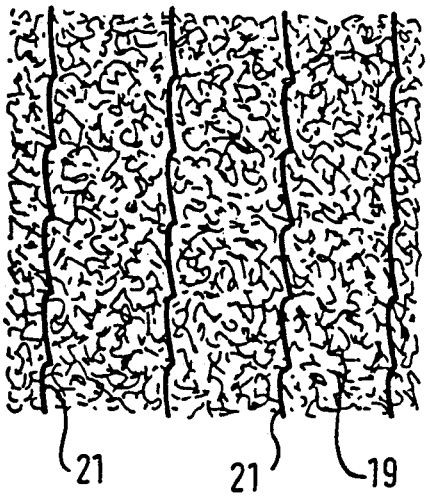
FIG. 3 shows the reverse of said embodiment in section.
Figure 4:
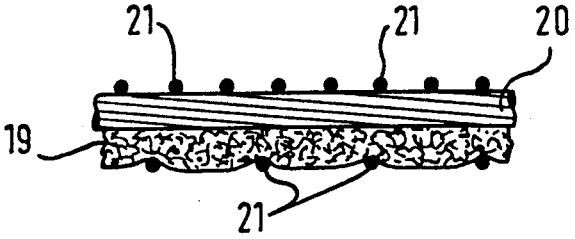
FIG. 4 is a cross-section through line IV—IV in FIG. 3.
Figure 8:
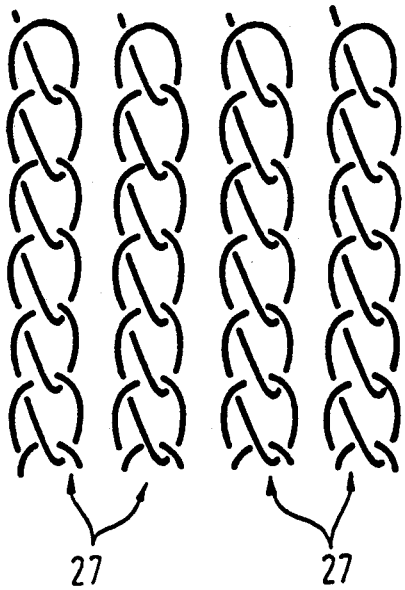
FIG. 8 shows another possible weave of the stich wale of the warp knit fabric.

FIGS. 2 and 3 show sections of the front side and the rear side of the first embodiment of the interfacing according to the invention, in which the nonwoven fabric 19 is joined with the weft threads 20 by the stitches 21 of the warp knit fabric in such a manner that the weft threads are incorporated on the front side of the stitches 21 (stich loop side). The stitches lying over one another should be joined with each other in open or in closed pillar stitch formation to form stitch wales 22. FIG. 7 shows the section of a warp knit fabric in an open, non-offset pillar stitch weave in a separate representation, whilst FIG. 8 shows a warp knit fabric with stich wales in a closed, non-offset pillar stitch weave.

Figure 5:
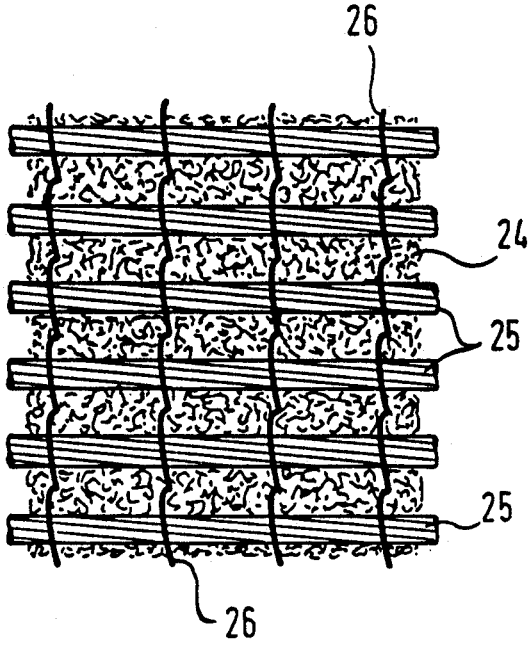
FIG. 5 shows a section of the front side of a second embodiment of the interfacing according to the invention.
Figure 6:
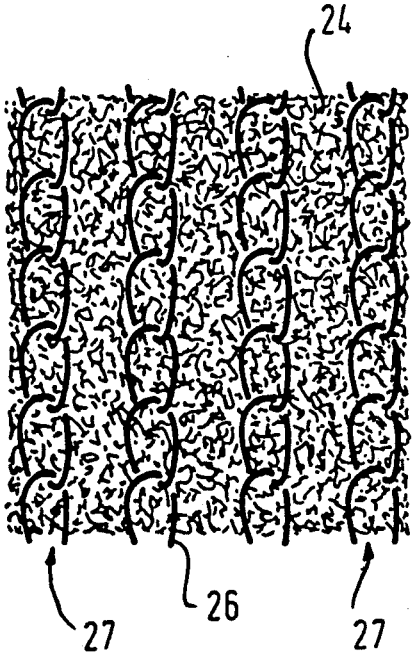
FIG. 6 shows the reverse of said embodiment in section.

FIGS. 5 and 6 show sections of the front side and the rear side of the second embodiment of the interfacing according to the invention, the nonwoven fabric 24 being joined with the weft threads 25 by the stitches 26 of the warp knit fabric in such a manner that the weft threads are incorporated on the reverse of the stitches (underside of the stitches). Here as well, the stich wales 27 of the warp knit fabric may have an open, non-offset pillar stitch weave, as shown in FIG. 7, or a closed, non-offset pillar stitch weave, as shown in FIG. 8.

Figure 9:
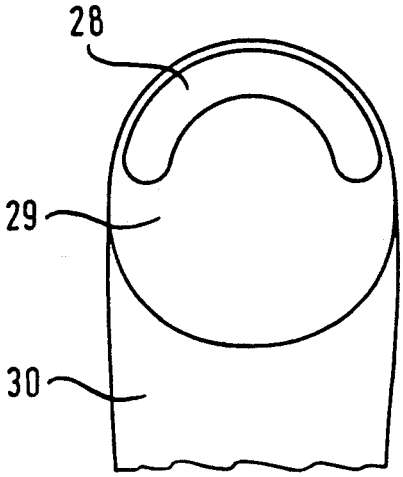
FIG. 9 shows a dismantled representation of the sleeve of an outer garment with a panel interfacing inserted in the armhole.

FIG. 9 shows the interfacing according to the invention for use as an additional stiffener in the form of a so-called sleeve sickle 28, which is inserted in the armhole 29 of the sleeve 30 of an outer garment.

EXAMPLE 1

A spot-bonded, approximately 2 m wide nonwoven fabric of weight class 30 g/cm$^2$, nonwoven fibre count 1.2 dtex and nonwoven fibre composition 70% polyamide and 30% polyester staple fibres, is passed horizontally from a normal nonwoven Raschel machine with weft insertion to the knitting machines. At the same time, the guide bars of the nonwoven Raschel machine admit multifilament warp threads of count 44 dtex with 33 fibres per warp thread. The warp material consists of polyester. The set of the warp is 47 threads per 10 cm. The nonwoven fabric is joined with the stitches in a single stich formation process via the guide bars guiding the warp threads and the compound needle sticking through the nonwoven fabric. A non-offset, closed pillar of stitches is formed. In so doing, one weft thread is inserted and incorporated into each stitch course via the weft-laying apparatus. The set of the weft threads and stitches is 80 threads or stitches/10 cm. The weft thread material consists alternately of a weft thread made of 40% polyamide and 60% viscose staple fibre of yarn count 1100 dtex and a resilient weft thread made of 19% polyester, 30% viscose staple fibre and 51% animal hair of yarn count 1250 dtex.

In order to avoid a severe loss of width in the nonwoven fabric, the nonwoven fabric is held taut in the transverse direction by means of roller fabric spreaders installed close to the knitting machines, the width of the inclined control rolls being approximately 300 mm.

The composite material leaving the nonwoven Raschel machine is wound and then washed out hot, with an impregnating liquor which contains the cellulose cross-linking agent, padded, dried and cross-linked at 185° C. and heat-set. The set of the weft is increased to 85 threads per 10 cm by stuffing at the point of entry into the finishing drier.

Use as a shoulder pad and as a backing panel interfacing.

EXAMPLE 2

Same embodiment as for example 1, with the following difference: A nonwoven fabric of weight class 40 g/m$^2$ is used. The weft thread material consists alternately of a 1250 dtex weft made of 19% polyester, 30% viscose staple fibre and 51% animal hairs and a further weft made of 700 dtex glazed multifilament yarn with 10 capillaries, covered with a 133 dtex cotton thread. The set of the weft when raw is 120 threads/10 cm and 130 threads/10 cm after finishing and heat-setting.

Use as an additional stiffener.

EXAMPLE 3

Same embodiment as for example 1 with the following difference: Use of a nonwoven fabric of weight class 30 g/m$^2$ which is needle-punched with a thin 1.8 mm thick layer of polyurethane ester foam with a weight of 35 g/m$^2$.

Use as a sleeve shoulder pad.

We claim:

1. Interfacing made of a composite of a nonwoven textile, a warp knit fabric with synthetic multifilament fibres and weft threads for stiffening outer garments, characterised in that the composite has a) a loosely bonded nonwoven fabric (19) of fibre count(5) 1–5 dtex and of weight class 30–150 g/m$^2$, b) a warp knit fabric of warp thread count 20–80 dtex, set of the warp 40–70 threads/10 cm and fibre count (1) 1–3.5 dtex and c) resilient weft threads (20), incorporated into each stitch course of the warp knit fabric, of thread count (8) 300–2000 dtex, set of the weft 70–130 threads/10 cm and, for a fibre proportion in excess of 50% by weight, a fibre count of 7–1000 dtex.

2. Interfacing according to claim 1, characterised in that needle-punched nonwovens or waterjet-bonded nonwovens are contained in the composite.

3. Interfacing according to claim 1, characterised in that spot-bonded nonwovens with a synthetic fibre proportion in excess of 75% are contained in the composite.

4. Interfacing according to claim 1, characterised in that nonwovens, nedle-punched, spot-bonded and/or waterjet-bonded with each other, are contained in the composite.

5. Interfacing according to claim 1, characterised in that needle-punched, spot-bonded or waterjet-bonded nonwovens, which are joined with foam sheets, are contained in the composite.

6. Interfacing according to claim 1, characterised in that the warp knit fabric (21) has a non-offset pillar stitch weave.

7. Interfacing according to claim 1, characterised in that the warp knit fabric (21) has an offset pillar stitch weave.

8. Interfacing according to claim 1, characterised in that the weft threads (20) contain resilient staple fibres made of rayon, goat hair, horsehair or synthetic fibres.

9. Interfacing according to claim 1, characterised in that the weft threads (20) contain monofilament or multifilament threads.

10. Interfacing according to claim 1, characterised in that it has a flexural strength in the weft direction, measured in accordance with DIN 53362, of 5.0 to 120 p/cm$^2$.

11. Interfacing according to claim 1, characterised in that it is coated on the weft thread side with hot-melt adhesive in the form of a grid of dots.

12. Interfacing according to claims 1 and 11, characterised in that rows of dots of hot-melt adhesive arranged in parallel thereupon, with a spacing between the dots (18) of around 0.5–1.5 cm and a spacing between the rows of around 2.5–4 cm, at an angle of 30° to 60°, preferentially approximately 45°, to the weft thread direction are placed on the weft thread side of the interfacing.

13. Interfacing according to claim 1, which is joined with a backing panel interfacing as an additional panel interfacing in the form of a shoulder, armhole and/or shoulder area backing, which serves to stiffen the breast, shoulder, armhole and/or shoulder area of garments, characterised in that the interfacing (12) and the backing panel interfacing (5) with the weft sides lying together are pick stitched (joined) with approximately parallel rows of stitches (13), which run at an angle to the warp thread direction (10) of 30° to 60°, preferentially approximately 45°, and are stitched approximately parallel to the warp direction of the backing panel interfacing, the sewing stitches of the rows of sewing stitches being approximately 1.0 to 2.5 cm apart and the rows of sewing stitches being approximately 3 to 7 cm apart.

14. Interfacing according to claims 1 and 11, which is joined with a backing panel interfacing as an additional panel interfacing in the form of a shoulder, armhole and/or shoulder area backing, which serves to stiffen the breast, shoulder, armhole and/or shoulder area of outer garments, characterised in that the interfacing (12) is heat-set onto the backing panel interfacing (5) via its coating of hot-melt adhesive and that the warp threads of the backing panel interfacing are arranged approximately parallel to the rows of dots of hot-melt adhesive of the interfacing in the hot-melt adhesive composite.

15. Interfacing according to claim 14, joined with a backing panel interfacing, which is joined at its cut edges with a whole-piece interfacing heat-set onto one part of an outer garment, characterised in that its composite with the backing panel interfacing (5) has an arrangement such that its warp threads in the outer garment come to lie parallel to a diagonal line (14) from the starting point of the shoulder area (15) at the neck to the lowest point of the armhole (16) of the outer garment.

16. Interfacing according to claim 1 which, as an additional panel interfacing in the form of a sickle-shaped stiffener for the sleeve of an outer garment in the rounded area at the top of the arm, is attached to a correspondingly cut base interfacing heat-set onto the fabric of the sleeve, characterised in that the panel interfacing cut into a sickle shape (28) is placed on the base interfacing and is sewn at the cut edges of the rounded area at the top of the arm to the rounded area at the top of the arm in such a manner that the weft threads of the panel interfacing at the lateral regions of the rounded area at the top of the arm are at an angle of approximately 65° to 90° to the seam of the rounded area at the top of the arm of the garment and at an angle of approximately 0° to 35° to the upper region at the seam at the starting point of the shoulder of the outer garment.

17. Interfacing according to claim 16, characterised in that the base interfacing consists of a soft composite of a nonwoven textile, a warp knit fabric with synthetic threads and soft weft threads incorporated into the stitches of the warp knit fabric with a coating of dots of hot-melt adhesive applied to the weft side.

18. Use of the interfacing according to one or more of claims 1 to 17 as a backing panel interfacing for stiffening regions of garments.

19. Use of the interfacing according to one or more of claims 1 to 17 as an additional stiffening panel for garments.

20. Use of the interfacing according to one or more of claims 1 to 17 as a component of shoulder pads.

21. Use of the interfacing according to one or more of claims 1 to 17 for stiffening sleeves in garments in the rounded area at the top of the arm.

* * * * *